United States Patent [19]

Lucht

[11] Patent Number: 4,479,451

[45] Date of Patent: Oct. 30, 1984

[54] SAIL WITH AIR ENVELOPE AND CONTOUR SHAPING PARTS

[76] Inventor: Friedrich Lucht, Parlament, 2251 Pellworm, Fed. Rep. of Germany

[21] Appl. No.: 450,057

[22] Filed: Dec. 15, 1982

[30] Foreign Application Priority Data

Dec. 16, 1981 [DE] Fed. Rep. of Germany ..... 3149838

[51] Int. Cl.[3] ..... B63H 9/04

[52] U.S. Cl. ..... 114/104

[58] Field of Search ..... 114/39, 90, 102–105, 114/108, 106, 107

[56] References Cited

U.S. PATENT DOCUMENTS

| | | | |
|---|---|---|---|
| 3,132,620 | 5/1964 | Court | 114/102 |
| 3,867,894 | 2/1975 | Vicard | 114/102 |
| 4,016,823 | 4/1977 | Davis | 114/90 |

*Primary Examiner*—Trygve M. Blix
*Assistant Examiner*—Jesûs D. Sotelo
*Attorney, Agent, or Firm*—Steinberg & Raskin

[57] ABSTRACT

A sail with a tubular portion is pulled over a mast and/or a stay of a sailing vessel. The tubular portion is inflatable through a sail mouth opening at the fore leech thus forming an air envelope of the sail due to the relative wind effects. A plurality of telescoping contour sleeves formed of a lightweight, floating, elastic material are arranged in the tubular portion and sheath the mast and/or stay as well as selected portions of the rigging. The formation of an air envelope from a part of the sail and the use of rotatable streamlined contour sleeves inhibit complete heeling over of the sailing vessel and simplify the erecting of surfboards and sailboats. The telescoping arrangement of the contour sleeves permits an alteration of the sail surface and the sheathing of the rigging further decreases the wind resistance leading to an increased speed capability without need for greater inclination of the vessel. Thus the sails are better able to utilize the wind energy.

22 Claims, 16 Drawing Figures

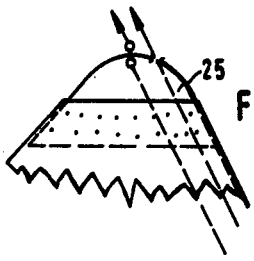
FIG.8
FIG.7
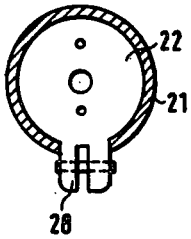
FIG.9
FIG.6
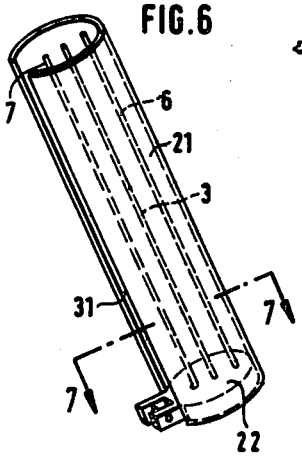
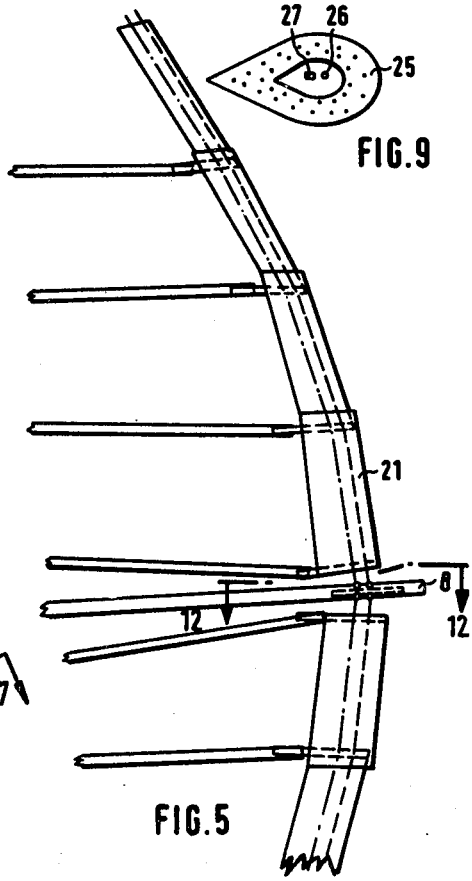
FIG.5

FIG.16
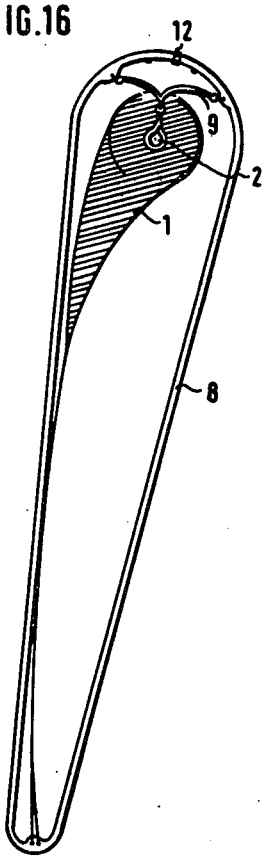
FIG.10
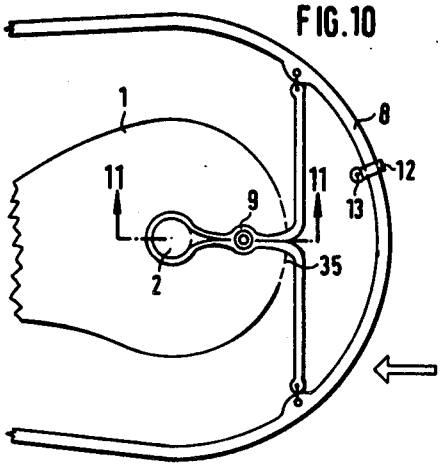
FIG. 12
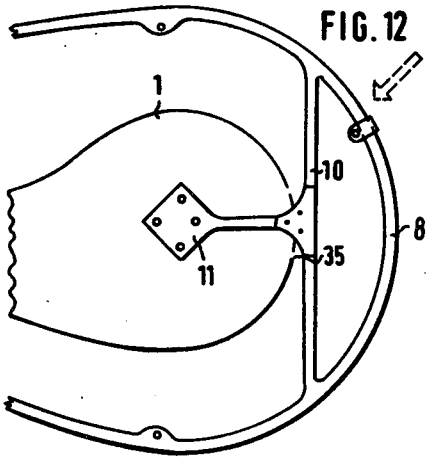
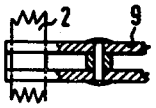
FIG.11

32
3
33
15
33
15

33
34

25
1
32
1
8
2
24
20

SAIL WITH AIR ENVELOPE AND CONTOUR SHAPING PARTS

BACKGROUND OF THE INVENTION

This invention relates to sails, and more particularly to the forming of an air envelope in a sail and the shaped parts for the contouring of sails.

In the building of sailboats, much effort is devoted to improving the contour of the sails and reducing the resistance or wind drag of the rigging. A well known prerequisite of sailboats is that the craft must utilize the atmospheric wind from two sides.

The use of a contour mast with a mast contour that extends sternward beyond the usual streamline form of the fixed mast is a well known approach to improving the contour of the sail and enabling the craft to utilize atmospheric wind from two sides. The contour mast generally has a rotatable arrangement and can be run with a semirigid sail or with a lath sail as described in Segler Lexikon published by Joachim Schult Verlag Klasing and Co. GmbH, Bielefeld 1978, Second Edition, page 311. In many instances the rigid sail parts have a streamlined form with concave and nonvariable arches on both sides. Rigid sails, however, have not been widely accepted because they cannot be given a slight but often critical twist which at any level above the water gives the sail the correct angle of incidence that corresponds to the wind gradient of the atmospheric wind at an increasing level of the surface of the water (cf. The Sail-Jeremy Howard-Williams, German edition published by Klasing and Co., Bielfeld and Berlin 1969).

Other known sail arrangements such as the rigging for a sail plank or surfboard with a sail as disclosed in German Pat. No. 1,914,604 and a wind propelled vehicle as disclosed in Australian Pat. No. 46552/79 relate to the attachment of the mast on a sail plank or surfboard as well as the connection between the mast and two outwardly curved main booms. The German Pat. No. 1,914,604 further teaches that the fore leech of a sail for a sail plank or surfboard can be formed as a hem into which the mast is introduced. However, it has been found that no fundamental improvement in the contour of the sail is achieved as long as the mast remains the edge of wind attack of the main sail.

It is thus desirable to provide a sail which is not dependent on the mast to form the edge of wind attack of the main sail.

SUMMARY OF THE INVENTION

Accordingly it is an object of the invention to dispose the mast and/or the stay in the sail such that the contour of the sail is not dependent upon or dictated by the curvature of the mast and/or the stay. A further object of the invention is to utilize lightweight contour forms and an inflation of a contour envelope of the sail by relative wind effects to form a contour in the sail favorable for sailing vessels.

In accordance with the present invention, the sail includes a tubular air envelope portion at a front of the sail for running on a mast and/or stay. A plurality of telescoping contour sleeves are disposed in the tubular portion to sheath the mast and/or stay when the tubular portion is run on the mast and/or stay. Each of the contour sleeves have a perforated baseplate, and a flexible tension member such as a cord is passed through one of the perforations in each of the baseplates. Knots provided in the cord above the below the baseplates hold the contour sleeves in a predetermined telescopically extended position when the sail is run on the mast or the stay. A sail mouth opening in the tubular portion receives air to inflate the tubular portion thus forming the air envelope of the sail.

Certain portions of the rigging can also be sheathed by the contour sleeves to reduce the wind resistance of the rigging. As the contour sleeves are lightweight, mobile and streamlined contour parts, the wind resistance can be reduced substantially. Thus a greater increase of speed can be obtained without the need for greater inclinations of the sailing vessel. Consequently there is optimum wind utilization of the sails. Other features and advantages of the invention will be apparent from the following description.

DESCRIPTION OF THE DRAWINGS

A more complete appreciation of the present invention and many of the attendant advantages thereof will be readily understood by reference to the following detailed description when considered in connection with the accompanying drawings in which:

FIG. 5 is a fragmentary view of the contour sleeves telescopically extended for stay conduction in accordance with another embodiment of the invention;

FIG. 6 is a perspective view of a contour sleeve thereof with an oval baseplate for stay conduction;

FIG. 7 is a section taken on the line 7—7 of FIG. 6;

FIG. 8 is a fragmentary side view of a sail cap;

FIG. 9 is a plan view of the sail cap;

FIG. 10 is an enlarged fragmentary section through a mast double boom connection taken on the line 10—10 of FIG. 1;

FIG. 11 is a section taken on the line 11—11 of FIG. 10;

FIG. 12 is an enlarged fragmentary section through a stay double boom connection taken on the line 12—12 of FIG. 5;

DESCRIPTION OF A PREFERRED EMBODIMENT

Figure 4:
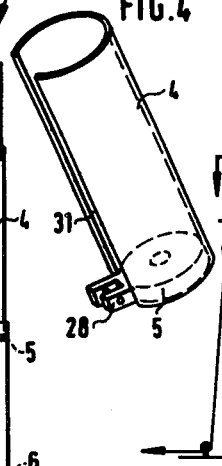
FIG. 4 is a perspective view of a contour sleeve thereof with a baseplate.
Figure 3:
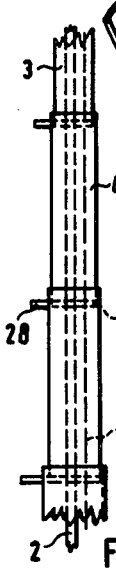
FIG. 3 is a fragmentary view of the contour sleeves thereof in telescopically extended position.
Figure 1:
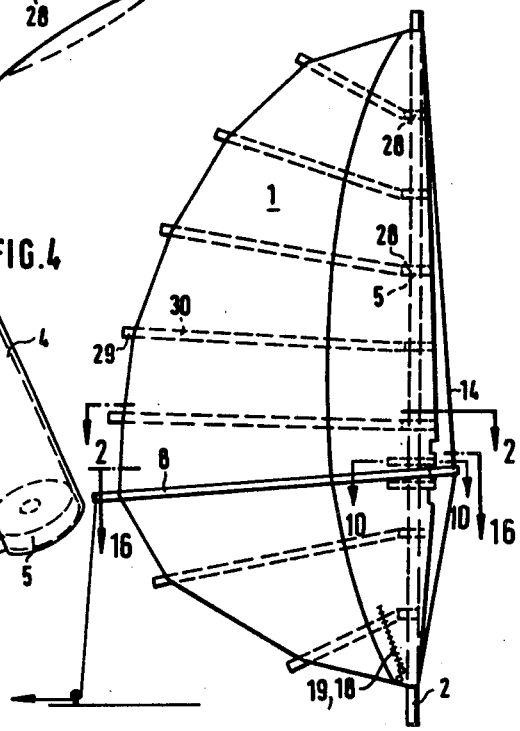
FIG. 1 shows a rigging with contour sails for mast conduction, incorporating one embodiment of the present invention.

Referring now to the drawings, wherein like reference characters depict identical or corresponding parts throughout the several views, the rigging for a sail 1 is shown in FIG. 1. The rigging includes a mast 2 sheathed by contour sleeves 4 with baseplates 5 that are bonded to the contour sleeves 4. The contour sleeves 4, as shown in FIGS. 3 and 4, are connected together in telescope fashion and are formed of any suitable lightweight elastic foam material that will float easily.

The sail 1 is hoisted on the mast 2 between a double boom 8 that surrounds the sail as most clearly shown in FIG. 16. The tubular portion of the sail 1 is thus pulled over the mast 2 and the contour sleeves 4. Such pulling is facilitated by opening a pair of zippers 18, 19 provided at opposite sides of a bottom portion of the tubular part of the sail 1. The zippers 18 and 19 open from the bottom up.

Figure 2:
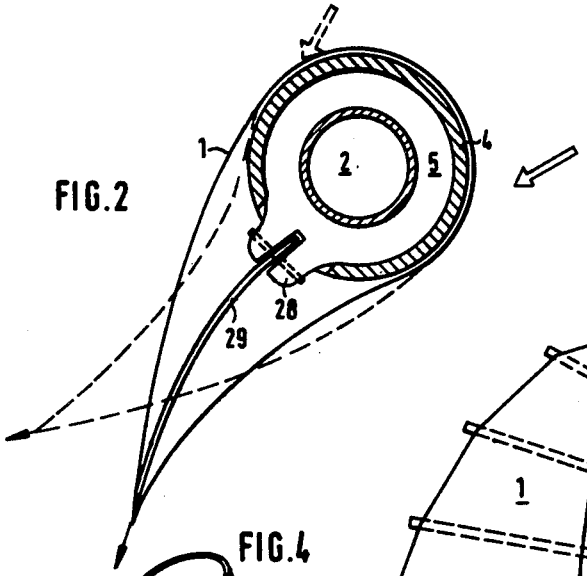
FIG. 2 is a section taken on the line 2—2 of FIG. 1.

Battens or sail edges 29 are provided in lath pockets 30 that extend through the tubular part of the sail to extensions 28 of the baseplates 5. The sail edges 29 are pivotally secured to the extensions 28 by means of bolts, as seen in FIG. 2, for pivotable upward and downward movement with respect to the baseplates 5.

FIG. 10 shows the connection between the mast 2 and the double boom 8 by means of a strut 10 and a clamp 9 such as sold in Germany under the trademark NIROSTA. The clamp 9 is preferably made of a rust-proof and acid-proof steel alloy and extends through one of several openings in the sail 1, such as the sail mouth 35, and embraces the mast 2. The clamp 9 has opposite extending legs fastened at both ends to the double boom 8 and a screwable bolt as shown in FIG. 11. A sliding ring 12 with a bore 13 serves to guide a turbulence cord 14 (FIG. 1).

While FIGS. 1–4 show a novel rigging for mast conduction, FIGS. 5–7 show corresponding parts for stay conduction. Contour sleeves 21, as utilized for stay conduction, are shown round, although their baseplates 22 may be oval according to FIG. 6 or round as in FIG. 7. The baseplates 22 have respective bores for the conduction of the stay 3, as well as a telescope cord 6 and a downhaul 7. As shown in FIG. 5, the contour sleeves 21 have their greatest diameter at the level of the double boom 8. The baseplates 22 are bonded to the sleeves 21, which are also preferably made of foam material.

The telescoping of the contour sleeves 4 and 21 is accomplished by means of the telescoping cord 6, a flexible tension member, which has knots above and below each of the baseplates 5 and 22 to form a connection with said baseplates and thereby hold the sleeves in a predetermined telescopically extended position. The contour sleeves 4 and 21 as shown in FIGS. 4 and 6 include cutouts 31 in the aft-leech direction which guide the lath retention extensions 28 of the next baseplates 5, 22 when the contour sleeves 4, 21 are collapsed.

Referring to FIGS. 5 and 12, the double boom 8 is connected with the stay 3, which is shackled in on the underside of a plate 11 such as sold in Germany under the trademark NIROSTA. The plate 11, which is preferably of a material similar to that of the clamp 9 protrudes through the sail mouth opening 35 of the sail 1 and has bores for guiding the stay 3, the telescoping cord 6 as well as the up and down hauls.

Figures 13, 14, 15:
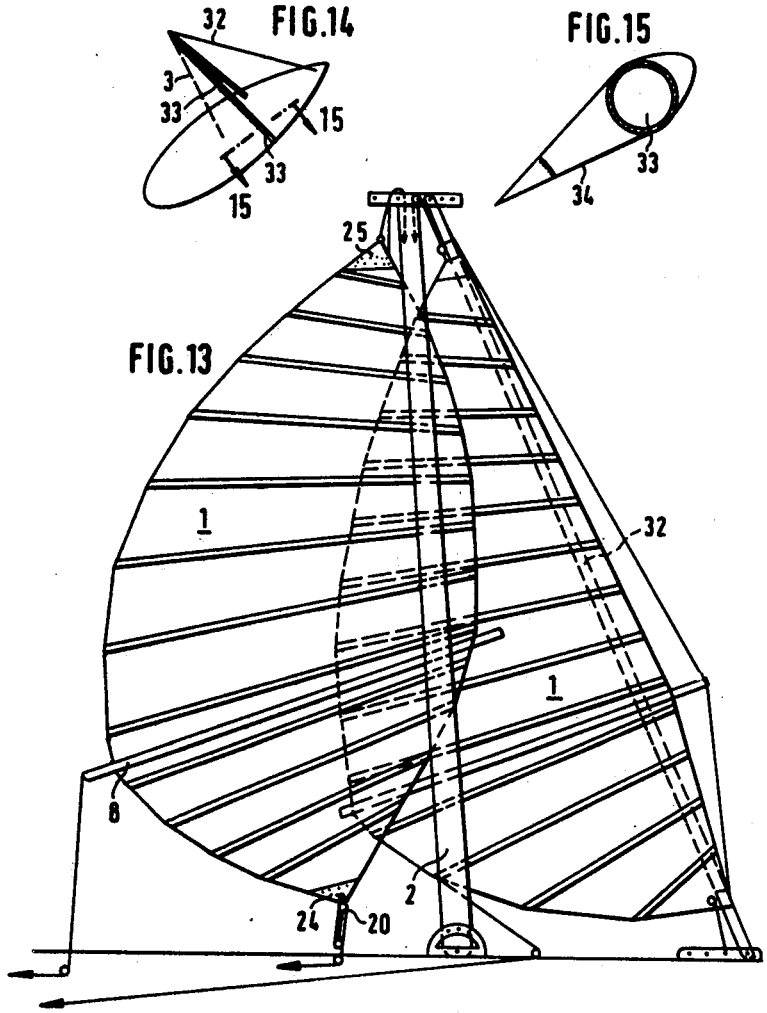
FIG. 13 shows two sails set on the stay and support mast on a relatively large boat with a splay mast incorporating a further embodiment of the invention.
FIG. 14 schematically shows a rigging for contour sail conduction of a yacht according to FIG. 13.
FIG. 15 is a section through a mast with streamlined rotatable jacketing taken on the line 15—15 of FIG. 14; and, FIG. 16 is a section through a double boom with sail taken on the line 16—16 of FIG. 1.

The sail shown in FIG. 13 is hoisted with stay conduction between a sail shoe 24 and a sail cap 25. The sail cap 25 as shown in said view in FIG. 8 and in plan view in FIG. 9 has a hole 26 at its center to receive a swivel 27 which receives the halyard. The telescoping cord 6 and a downhaul 7 are disposed at an inward prolongation of the swivel 27 in the sail cap 25. Zippers such as 18 and 19 of FIG. 1 may also be provided at the sail shoe 24.

FIG. 14 shows in schematic fashion a rigging for contour sail conduction of a yacht, with the known mast stiffenings being dispensed with for ease of description. The main sail is run, as in FIG. 13, by means of a wire stay 3, the foresail on a mast support 32. If on relatively large boats the rigging is changed by displacing the mast from midships sideways as a splay mast against the board walls, by omission of any mast struts, the best propulsion values are achieved especially on rough sailing courses.

FIG. 15 is a section through a round mast 33 from the head to the lateral board walls. In FIG. 15 the mast 33 has a streamlined rotatable sheath 34.

Some advantages of the invention evident from the foregoing description include an air envelope and shaped parts for the contouring of a sail so as to decrease the wind resistance and correspondingly lead to an increase in speed without the need for greater inclinations of the vessel. Thus the sail as disclosed herein provides for optimum wind utilization, and the contour of the sail is not dependent upon the contour of the mast or limited by its support on a stay. Thus, in accordance with the invention the wind resistance can be reduced to one seventh.

What is claimed is:

1. A sail for support on at least one of an unstayed mast and a stay comprising, a tubular air envelope portion at a front of the sail for running on said mast or said stay, a plurality of telescoping contour sleeves disposed in said tubular portion for disposition around said mast or said stay when said tubular portion is run on said mast or said stay, each of said contour sleeves having a perforated baseplate, a flexible tension member passing through one of said perforations in each said baseplate and having means for connection to each of said baseplates to hold said sleeves in a predetermined telescopically extended position on said mast or said stay when said sail is run on said mast or said stay, and a sail mouth opening in said tubular portion.

2. The sail according to claim 1, wherein said tubular air envelope portion is approximately one third to one half the width of said sail.

3. The sail according to claim 1, including a double boom surrounding said sail.

4. The sail according to claim 1, wherein said sleeves are approximately fifty centimeters long.

5. The sail according to claim 4, wherein the direction of the aft-leech the contour sleeves have a cutout to guide the lath retention extension of the baseplate of the next following contour sleeve.

6. The sail according to claim 1, wherein said flexible tension member is a cord.

7. The sail according to claim 6, wherein the means for connection to each of said baseplates comprise knots.

8. The sail according to claim 1, wherein said tubular portion of said sail has a fore-leech and said sail mouth opening is a mouthlike opening at one portion of the fore-leech.

9. The sail according to claim 8, including a double boom surrounding the sail and wherein the sail has an aft arch and the double boom extends forward from the aft arch and is connected through the sail mouth opening with the mast by connection means.

10. The sail according to claim 9, wherein the double boom has opposite connection portions and the connection means comprise a clamp which embraces the mast and has oppositely extending end portions secured to the opposite connection portions of the double boom.

11. The sail according to claim 9, wherein the mast has a head and a foot and the double boom has a free fore-leech arch with a sliding ring provided thereon, said ring having a guide opening, and a turbulence cord extending from the head to the foot of the mast through the guide opening.

12. The sail according to claim 8, including a double boom surrounding the sail and wherein the sail has an aft arch and the double boom has a free fore-leech arch extending foreward from the aft arch, and a strut extending across the fore-leech arch, a plate extending from the strut through the sail mouth opening, means for connecting the plate to the strut, said plate having apertures for shackling in the stay and for guiding the flexible tension member.

13. The sail according to claim 12, having uppermost and lowermost contour sleeves when said sail is run on said stay, a sail cap at the top of the sail fastened to the uppermost contour sleeve, and a sail shoe at the bottom of the sail fastened to the lowermost contour sleeve, said sail cap and said sail shoe each having two openings, a swivel member receivable in a respective one of the openings in said sail cap and said sail shoe, and the sail stay being receivable in the respective other said opening in said sail cap and said sail shoe to guide said sail stay to said plate.

14. The sail according to claim 12, having a sail cap at the top of the sail and a sail shoe at the bottom of the sail, and the contour sleeves increase in diameter in a first direction from the sail cap to the plate and in a second direction from the sail shoe to the plate, and the telescopic spacing of the sleeves is variable and adjustable by said flexible tension member.

15. The said according to claim 1, wherein at least one of the mast and the stay and at least one downhaul are received in apertures disposed in said baseplates.

16. The sail according to claim 1, having an aft-leech and sail lath and wherein the baseplates have a lath retention extension in the direction of the aft-leech, said lath retention extension having a slit in which the sail laths are received, and a pivot member for connection to the sail laths to permit pivotal movement of the sail laths with respect to the baseplates.

17. The sail according to claim 1, wherein the sail has a sail shoe at the bottom of the sail and a zipper on both sides of the tubular envelope portion at the sail shoe to permit opening of the tubular envelope portion from the bottom up.

18. The sail according to claim 17, wherein said zippers have a length of approximately 40 centimeters.

19. An air envelope and shaped parts for the contouring of sails which are run on at least one of a round unstayed mast and a stay, comprising a tubular front sail portion, telescoping contour sleeves in said tubular said portion for pulling over at least one of the mast and the stay, each of the contour sleeves being provided with a perforated baseplate connected by a telescope cord held above and below each baseplate by knots.

20. The device of claim 19, wherein the sail has a fore-leech and includes a sail mouth opening in the tubular sail portion at at least one point of the fore-leech.

21. The device of claim 19, including a double boom surrounding said sail.

22. The device of claim 19, wherein the tubular front sail portion is approximately one third to one half the width of the sail.

* * * * *